US011910883B2

(12) United States Patent
To'oto'o et al.

(10) Patent No.: US 11,910,883 B2
(45) Date of Patent: Feb. 27, 2024

(54) ARTICLE OF FOOTWEAR WITH TRACTION ELEMENTS

(71) Applicant: Under Armour, Inc., Baltimore, MD (US)

(72) Inventors: Gabriel To'oto'o, Baltimore, MD (US); Spencer Hawkins, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 17/313,763

(22) Filed: May 6, 2021

(65) Prior Publication Data

US 2021/0345726 A1 Nov. 11, 2021

Related U.S. Application Data

(60) Provisional application No. 63/021,298, filed on May 7, 2020.

(51) Int. Cl.
*A43C 15/06* (2006.01)
*A43C 15/16* (2006.01)

(52) U.S. Cl.
CPC ..... *A43C 15/162* (2013.01); *A43C 15/161* (2013.01)

(58) Field of Classification Search
CPC .. A43B 5/00; A43B 5/02; A43B 5/185; A43B 13/26; A43B 13/22; A43B 13/226; A43B 13/24; A43C 15/161; A43C 15/162
See application file for complete search history.

(56) References Cited

U.S. PATENT DOCUMENTS

| | | | | |
|---|---|---|---|---|
| 4,674,207 | A * | 6/1987 | Yamaguchi | A43C 15/162 36/134 |
| 5,058,292 | A * | 10/1991 | Tanel | A43C 15/162 36/67 R |
| 5,873,184 | A * | 2/1999 | Ihlenburg | A43B 13/26 36/126 |
| 9,955,752 | B2 * | 5/2018 | Ito | A43B 7/148 |
| 2005/0097783 | A1 * | 5/2005 | Mills | A43C 15/162 36/126 |
| 2012/0279091 | A1 * | 11/2012 | Baucom | A43B 3/0068 36/67 A |
| 2013/0067772 | A1 * | 3/2013 | Auger | A43B 17/02 36/103 |
| 2014/0345164 | A1 * | 11/2014 | Campbell | A43C 15/162 36/103 |
| 2015/0040438 | A1 * | 2/2015 | Baucom | B29D 35/128 12/142 R |
| 2016/0366983 | A1 * | 12/2016 | Minami | A43C 15/162 |
| 2018/0125169 | A1 * | 5/2018 | Hirai | A43C 15/162 |

* cited by examiner

*Primary Examiner* — Sharon M Prange
*Assistant Examiner* — Erick I Lopez
(74) *Attorney, Agent, or Firm* — Edell, Shapiro & Finnan, LLC

(57) ABSTRACT

An article of footwear includes a midsole, a cleat plate including a bottom surface that faces toward a ground surface when the article of footwear is worn by a user, and a traction element connected with the cleat plate. The traction element includes a base member that is embedded within the cleat plate and a ground engaging member that extends from the base member and is exposed and extends transversely from the bottom surface of the cleat plate, where the ground engaging member has a length that is greater than a lengthwise dimension of the base member.

7 Claims, 16 Drawing Sheets

ARTICLE OF FOOTWEAR WITH TRACTION ELEMENTS

CROSS-REFERENCE TO RELATED APPLICATION

This application claims priority from U.S. Provisional Patent Application Ser. No. 63/021,298, filed May 7, 2020, and entitled "Article of Footwear With Traction Elements", the disclosure of which is incorporated herein by reference in its entirety.

FIELD OF THE INVENTION

The present invention relates to an article of athletic footwear including traction elements or cleats.

BACKGROUND

Articles of footwear (also referred to herein as shoes) typically include an upper and a sole structure attached to the upper. The sole structure can include a midsole and an outsole or cleat plate, where the cleat plate has a lower or bottom exterior surface that can include traction elements that are suitable for an intended purpose of use for the shoes. For example, certain types of athletic shoes, such as shoes intended for use in sports such as soccer, baseball or football, include cleat plates or cleat plates that are provided with traction elements in the form of cleats that extend a certain distance from the bottom exterior surface of the cleat plate to provide an enhanced traction or gripping of the shoe to a ground surface (e.g., grass and/or artificial turf) during use of the shoe. These cleat configurations, while providing traction, create a series of pressure points along the bottom of the wearer's foot, which may result in wearer discomfort.

It would be desirable to provide a traction system for a shoe that, while providing traction, further provides wearer comfort.

SUMMARY OF THE INVENTION

In an embodiment, an article of footwear comprises a midsole, a cleat plate including a bottom surface that faces toward a ground surface when the article of footwear is worn by a user, and a traction element connected with the cleat plate. The traction element comprises a base member that is embedded within the cleat plate and a ground engaging member that extends from the base member and is exposed and extends transversely from the bottom surface of the cleat plate, where the ground engaging member has a length that is greater than a lengthwise dimension of the base member.

The length of the ground engaging member can be greater than a width of the ground engaging member. In addition, the base member can include a plurality of openings extending through the base member.

Further, the article of footwear can comprise a plurality of traction elements connected with the cleat plate, where the base member of each traction element is embedded within the cleat plate, and the ground engaging member of each traction element includes an interior surface that faces toward a central lengthwise axis of the article of footwear and an outer surface that faces away from the central lengthwise axis of the article of footwear.

In another embodiment, a traction element for an article of footwear comprises a base member that is embedded within a cleat plate of the article of footwear, the base member including a plurality of openings extending through the base member to facilitate portions of the cleat plate extending through the openings during installation of the base member in the cleat plate. The traction element further comprises a ground engaging member that extends from the base member and is exposed and extends transversely from the bottom surface of the cleat plate, where the ground engaging member has a length that is greater than a lengthwise dimension of the base member.

In a further embodiment, an article of footwear comprises an upper, a cleat plate coupled to the upper, the cleat plate including a plurality of nodules formed integral with the cleat plate, each nodule extending outward from a bottom surface of the cleat plate, and a plurality of metal cleats, each cleat associated with a corresponding nodule such that the cleat is encapsulated partially within the nodule and protrudes therefrom in a direction substantially perpendicular to the bottom surface of the cleat plate. Each cleat within the plurality of cleats possesses substantially the same dimensions.

In another embodiment, the cleat plate for the article of footwear includes metal cleats disposed along a portion of the cleat plate including a forefoot region and further includes polymer cleats disposed along a portion of the cleat plate including a hindfoot region.

The above and still further features and advantages of embodiments of the present invention will become apparent upon consideration of the following detailed description thereof, particularly when taken in conjunction with the accompanying drawings wherein like reference numerals in the various figures are utilized to designate like components.

BRIEF DESCRIPTION OF THE DRAWINGS

Like reference numerals have been used to identify like elements throughout this disclosure.

DETAILED DESCRIPTION

Figure 1A:
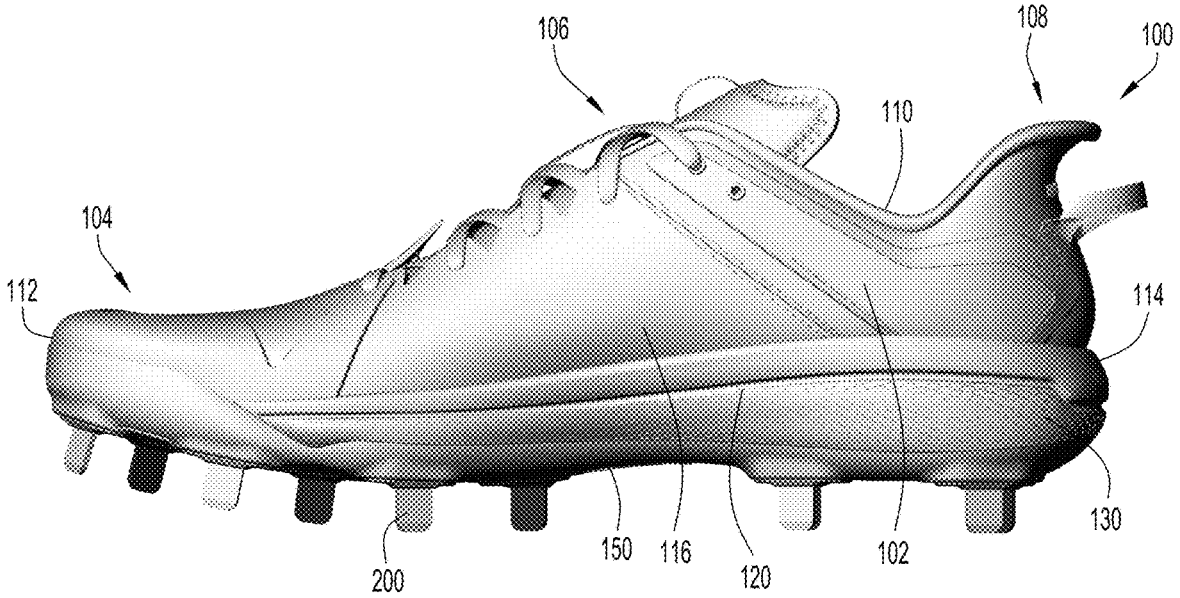
FIG. 1A is a medial side view in elevation of an article of footwear including a cleat plate with traction elements (cleats) according to an embodiment described herein.
Figure 1B:
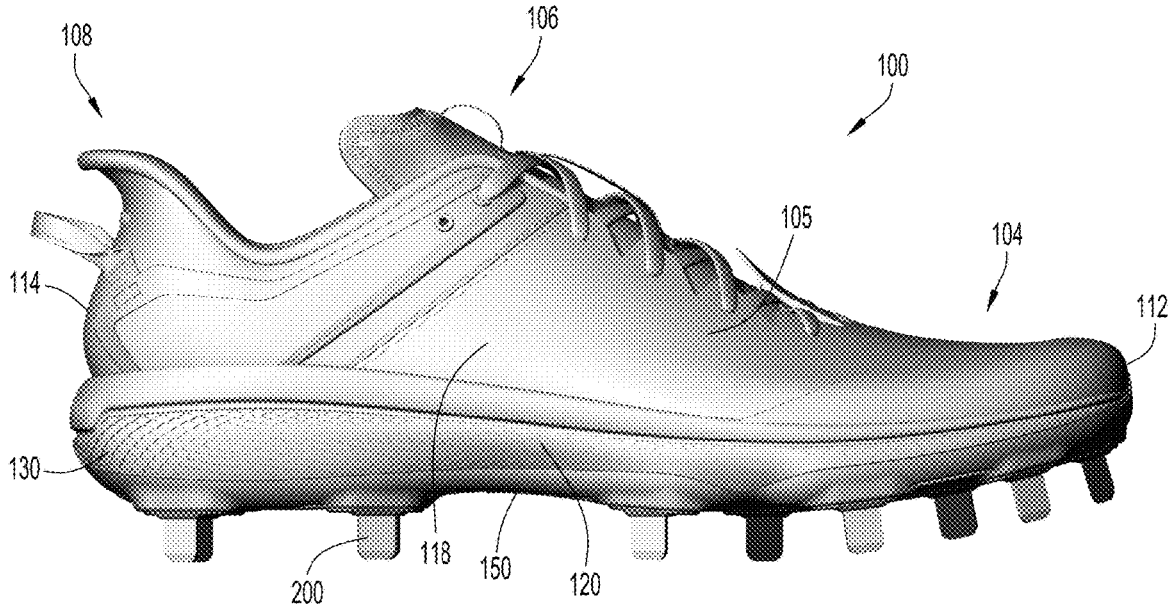
FIG. 1B is a lateral side view of the article of footwear of FIG. 1A.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

The article of footwear or shoe 100 is in the form of an athletic shoe (e.g., an athletic shoe for sports such as baseball, soccer or football). With reference to the example embodiments of FIGS. 1A-1D, an article of footwear or shoe 100 includes an upper 102 coupled to a sole structure 120. that includes a forefoot region 104 that generally aligns with the ball and toes of the foot of the user wearing the shoe and includes the toe end 112 of the shoe, a midfoot region 106 generally aligns with the arch and instep areas of the foot, and a hindfoot region 108 that generally aligns with the heel and ankle areas of the foot and which includes the heel end 114 of the shoe. The shoe 100 defines a medial side 116 oriented along the medial (big toe) side of the foot and a lateral side 118 oriented along the lateral (little toe) side of the foot. An opening at a top end of the upper 102 provides access to a cavity or interior 110 within the upper that is suitably dimensioned to receive and retain a user's foot when the shoe is worn for use.

While the example embodiments depicted in the figures show an article of footwear (shoe) configured for a right foot, it is noted that the same or similar features can also be provided for an article of footwear (shoe) configured for a left foot (where such features of the left footed shoe are reflection or "mirror image" symmetrical in relation to the right footed shoe).

The upper 102 of the shoe 100 can be formed of one or more layers, where each layer can comprise a textile (e.g., a textile formed via a knitting process, a woven process, a nonwoven process, an embroidered process, etc.), a laminate (e.g., a polyurethane laminate material) and/or any other material suitable for forming the upper, where the upper can further be formed as a single, unitary construction or as a plurality of sections connected with each other in any suitable manner (e.g., via stitching, via a molding process, via tape or other adhesive, etc.).

The sole structure 120 includes a midsole 130 coupled, mounted or attached to outsole or cleat plate 150 (also called a sole plate) with traction elements or cleats 200 along its bottom (ground-facing side). The midsole 130 can be formed of one or more compressible materials including, without limitation, ethylene vinyl acetate foam (EVA), an EVA foam blended with one or more of an EVA modifier, a polyolefin block copolymer, and a triblock copolymer, and a polyether block amide (e.g., a PEBAX® material), and a thermoplastic polyurethane (TPU) material. By way of further example, the compression material may be formed of foam comprising one or more olefin block copolymers. Some examples of suitable olefin block copolymers are those that can include α-olefin multi-block interpolymers, where the α-olefins can include, without limitation, C3-C20 α-olefins (e.g., C3-C10 α-olefins), such as propylene, 1-butene, 1-pentene, 1-hexene, 1-heptene and 1-octene. Some specific examples of suitable olefin block copolymers are commercially available under the trademark INFUSE® (Dow Chemical Company). In further example embodiments, the midsole includes about 65% or more by weight of one or more olefin block copolymers. In some embodiments, a textile surrounds the midsole, being bonded thereto. The textile includes a mesh fabric in having intersecting (e.g., crisscrossed) strands that defines openings or apertures of 1 mm or more in the fabric. This fabric web extends over the upper surface, lower surface, and/or side surfaces of the midsole. The fabric web may control movement of the foam and/or improve the compression and force attenuating properties thereof (e.g., by dispersing deformation along the midsole).

The Shore A hardness is selected to provide sufficient support to the wearer during game activities, and also to enable decoupling between the cleat plate and the foot movement to maximize cleat contact time with the ground. In an embodiment, the foam possesses moderate density, possessing a Shore A value of about 40-60 and, in particular, Shore A value of about 45-53.

The cleat plate 150 can be formed of a non-foamed, rigid polymer having sufficient tensile strength and durability (e.g., tensile strength of 1000 MPa or more). By way of example, the cleat plate is formed of a thermoplastic polyurethane or a thermoplastic elastomer polyether block amide such as a polyamide 12 compound. Additionally, the cleat plate 150 can be a carbon plate formed of woven carbon fibers embedded in resin. The cleat plate 150, then, is typically formed of a harder, more durable and abrasion resistant material in comparison to the midsole, while the midsole typically is softer and provides a selected amount of cushion for the shoe depending upon a particular application.

Figure 1C:
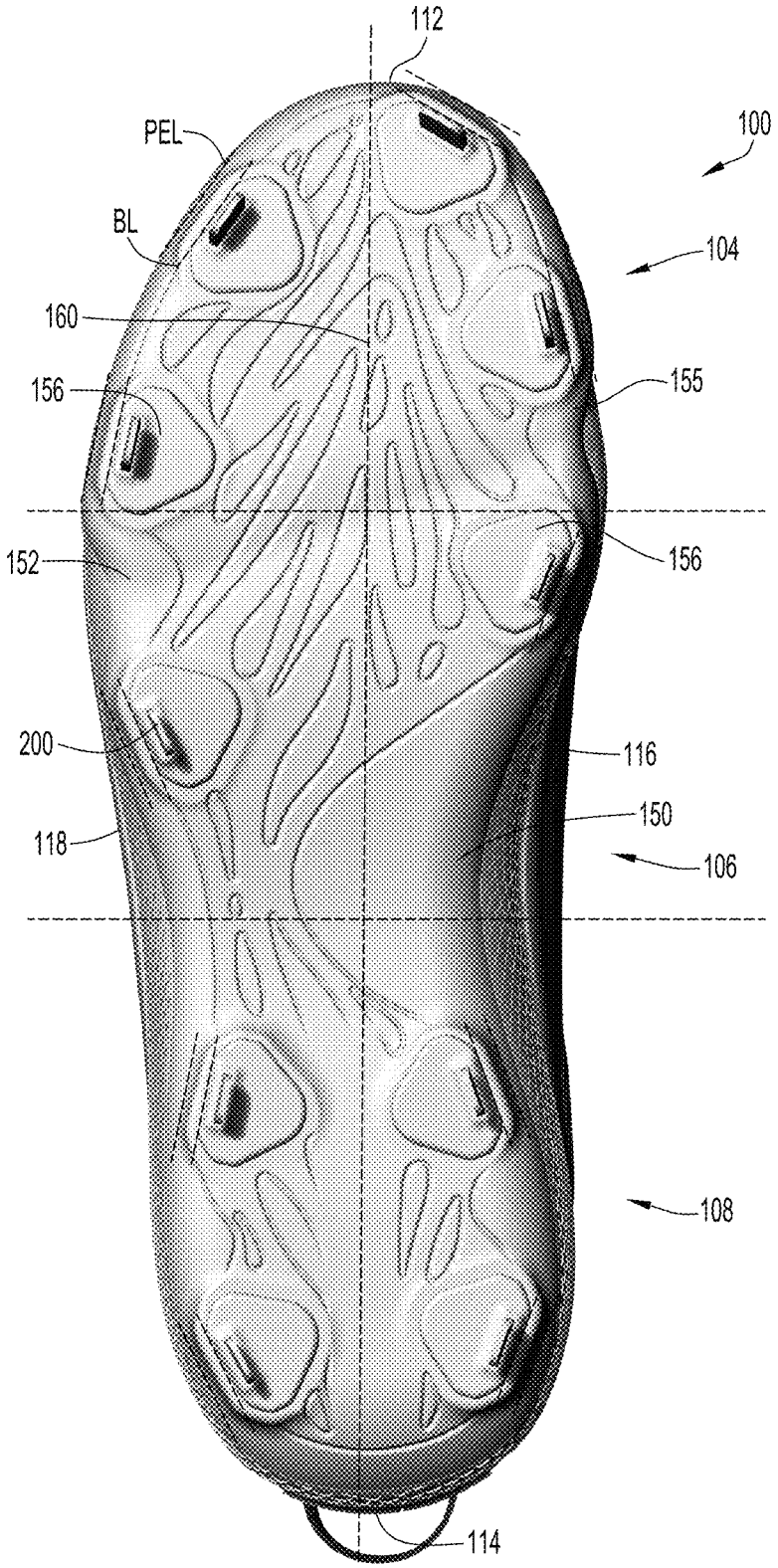
FIG. 1C is a bottom view in plan of the article of footwear of FIG. 1A.
Figure 1D:
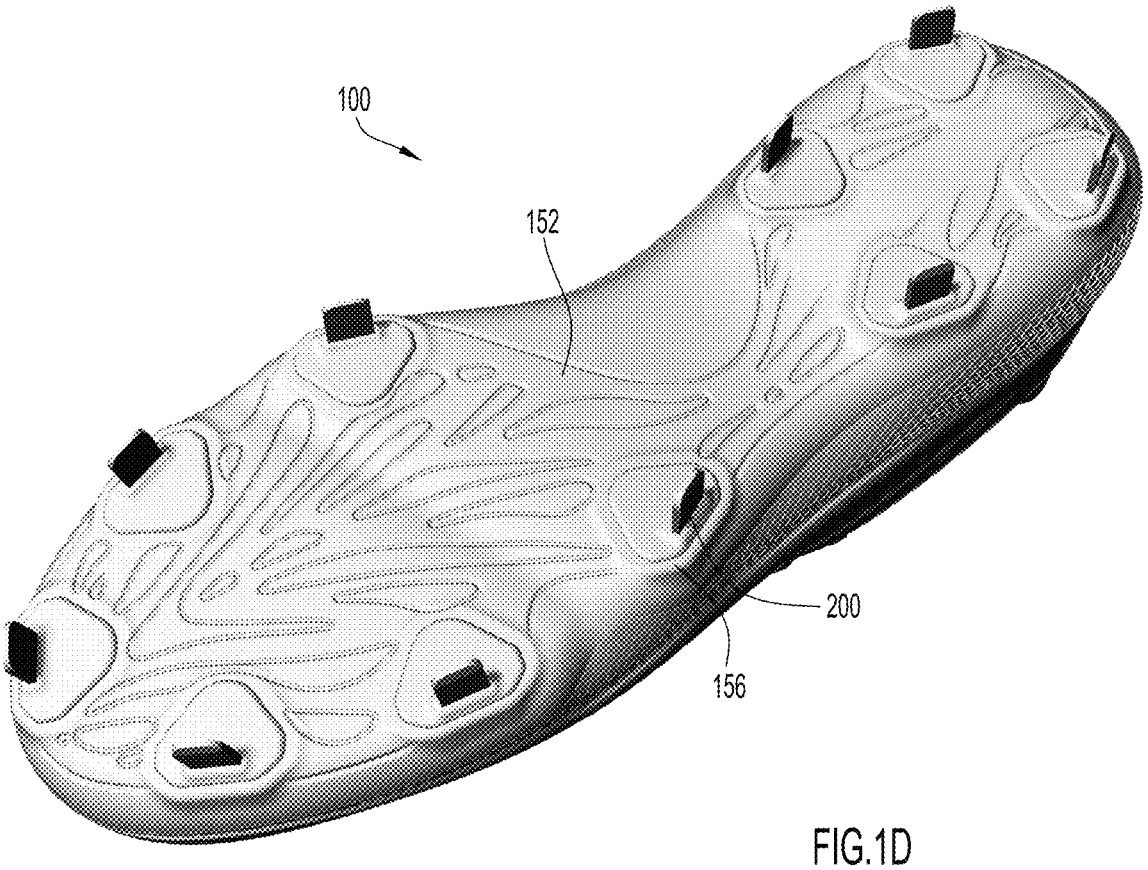
FIG. 1D is a bottom view in perspective of the article of footwear of FIG. 1A.

The cleat plate can include a two layered material structure (formed, e.g., via a co-molded, two shot process or any other suitable process). Referring to FIG. 1C, the bottom surface 155 of the cleat plate 150 includes a first material layer 152 that is integral with other sidewall surface portions of the cleat plate. The cleat plate 150 can also include a decorative second material layer (not shown) that overlies and is secured to the first material layer 152. The first and second material layers can be formed from the same or different materials. The second material layer can be provided in a decorative pattern over the first material layer 152, where the second material layer does not completely cover (thus leaving exposed portions of) the first material layer 152. The bottom surface 155 of the cleat plate further includes raised platforms, nodes or nodules 156, where each nodule 156 comprises a triangular raised and generally planar surface portion (which is defined at one or both of the first and second material layers). The shapes and dimensions of the nodules 156 conform to the base members or flanges of each cleat 200 as described herein. As described herein, each cleat 200 is partially embedded and secured to the cleat plate 150 at a corresponding nodule 156.

Referring to FIG. 1C, the bottom of the shoe 100 is depicted showing an example embodiment of a cleat configuration. Cleats 200 extend from a bottom surface 155 of the cleat plate 150 (at the nodules 156) and are arranged along the periphery of the bottom surface 155 at the medial side 116, lateral side 118 and at the toe end 112 and the heel end 114 of the shoe 100. As described herein, the cleats 200 include a base member or flange that extends within and is anchored by the cleat plate 150 and an exposed or ground engaging portion that extends transversely or orthogonal to the flange. As also described herein, the cleats 200 are arranged around and in a particular orientation in relation to the periphery of the bottom surface 155 of the cleat plate 150.

An example embodiment of a traction element or cleat that can be used for the shoe is described with reference to FIGS. 2A-2H. The cleats 200 can be formed of metal or any other suitable material having a hardness that is greater than the midsole and the outsole/cleat plate. In an example embodiment, the cleat is formed from stainless steel. The cleat may be formed from titanium, aluminum, one or more other grades of steel as well as other types of metals. The cleat may also be formed from other materials of suitable hardness and durability, including for example certain polyurethanes. In some embodiments, the cleat may be coated with a layer of tungsten for improved strength, durability, and wear resistance. The layer of tungsten may entirely coat the stem/post or coat only the portions of the cleat which protrude from the nodule or engage the surface on which the article of footwear is being used. The size and shape of the cleat, as will be described in more detail below, may significantly reduce the weight of the cleat, as compared to a conventional cleat.

Figure 2A:
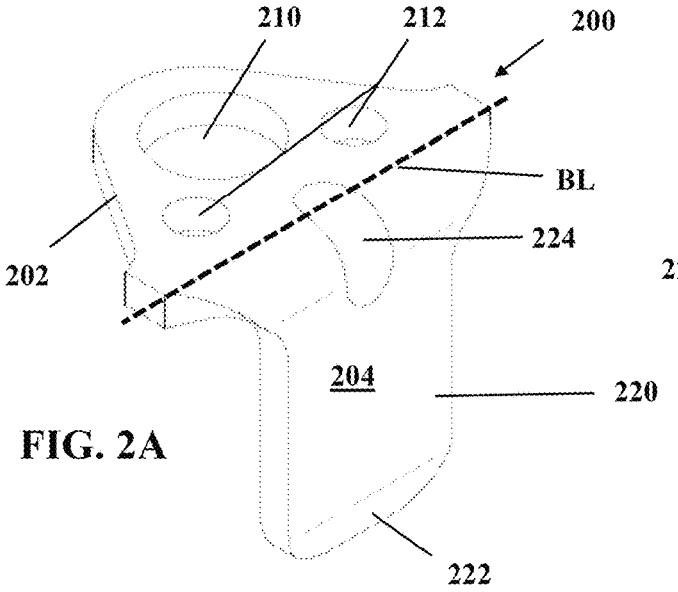
FIG. 2A is a bottom and rear view in perspective of a traction element (cleat) for the article of footwear of FIG. 1A.
Figure 2B:
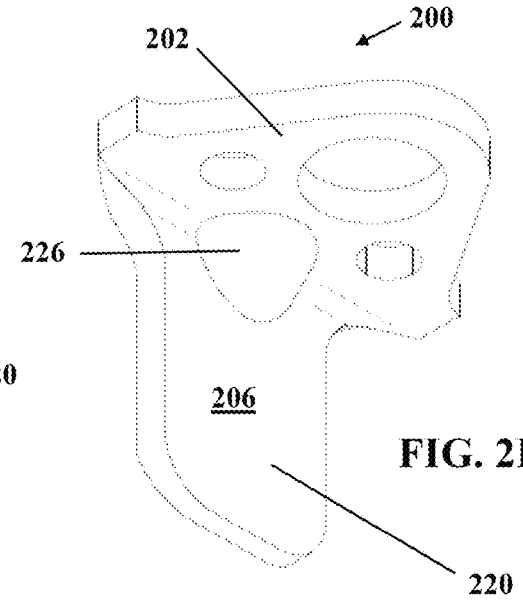
FIG. 2B is a bottom and front view in perspective of the traction element (cleat) of FIG. 2A.

The cleat 200 includes a base member or flange 202 and a ground engaging member or stem/post 220. When secured to the cleat plate 150, the post 220 is the portion of the cleat 200 that is exposed and extends from the bottom surface 155 of the cleat plate 150, while the flange 202 is partially or entirely embedded within the cleat plate 150 (e.g., within a corresponding nodule of the cleat plate as formed by the first material layer 152 or within both first and second material layers. The cleat 200 is a single, unitary member that is bent along a bend line BL (as shown in FIG. 2A) to define the flange 202 and the post 220 which is orthogonal to or extends at about a 90° angle from the flange 202. In other embodiments, the post 220 can extend from the bend line BL at any other angle from the flange 202 (e.g., at an angle ranging from about 60° to about 120°). The cleat 200 is thin, having a thickness of 1.30 mm to 1.60 mm (e.g., 1.50 mm).

The post 220 of each cleat 200 is further defined by its orientation along the cleat plate 150 in that post 220 includes a relatively flat outer surface 204 that corresponds with a rear side of the cleat, and which is the surface that faces outward and toward an outer peripheral edge line PEL of the bottom surface 155 for the cleat plate 150 and/or away from a central lengthwise axis 160 of the shoe 100 (as shown in FIG. 1C), and post 220 also includes a relatively flat inner surface 206 that corresponds with the front side of the cleat and that faces toward the central lengthwise axis 160 of the shoe 100.

In an embodiment, the post 220 of each cleat 200 has a generally planar shape, possessing a generally rectangular configuration and defining a distal free end or terminal end 222 that may be tapered so as to enhance engagement and penetration into a ground surface when the shoe engages the ground surface during use. An indentation or dimple 224 is provided along the outer surface 204 and at the bend line BL of the cleat 200, and a corresponding bump 226 is provided along the inner surface 206 at the bend line BL. The bump 226 and dimple 224 can be suitably aligned and dimensioned to enhance the strength and structural integrity for the configuration of the cleat 200 so as to prevent undesirable bending of the post 220 at the bend line BL and beyond its orthogonal (or other set angled) position in relation to the flange 202 during use of the shoe 100 (e.g., during activities in which the cleat is forced down so as to contact and/or penetrate a ground surface).

Figure 2C:
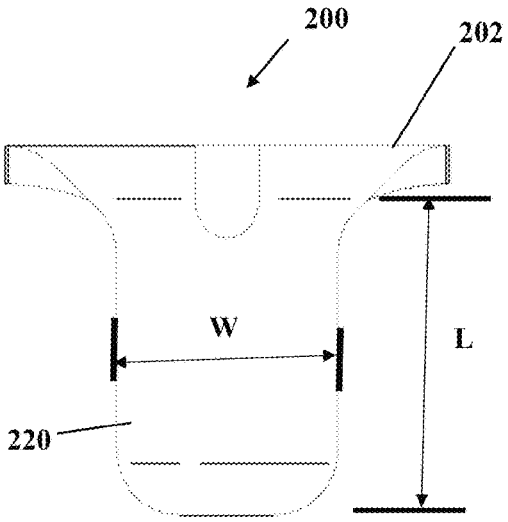
FIG. 2C is rear view in elevation of the traction element (cleat) of FIG. 2A.
Figure 2D:
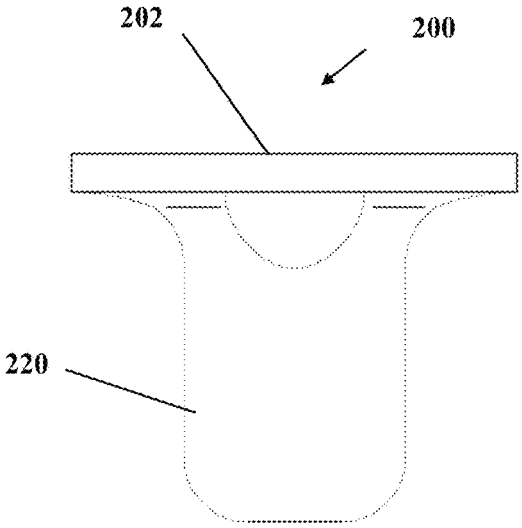
FIG. 2D is a front view in elevation of the traction element (cleat) of FIG. 2A.
Figure 2E:
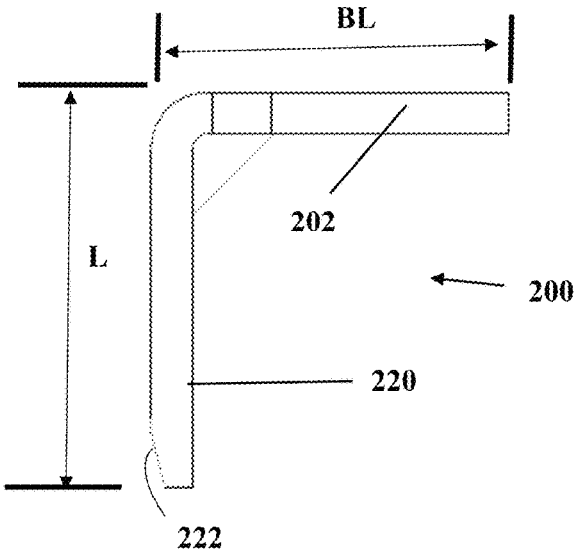
FIG. 2E is a first side view in elevation of the traction element (cleat) of FIG. 2A.
Figure 2F:
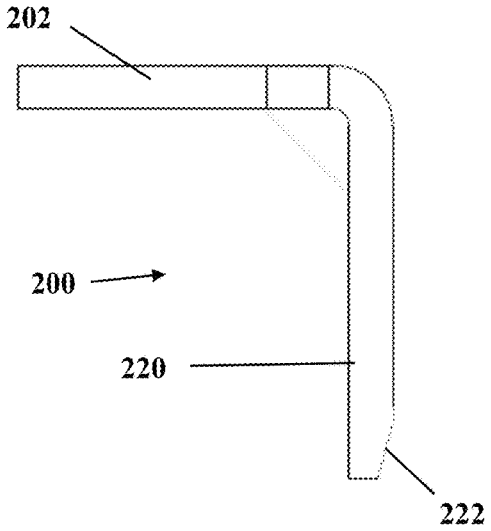
FIG. 2F is a second side view in elevation of the traction element (cleat) of FIG. 2A.

The dimensions of the cleat 200 are configured to minimize the contact surface of each individual cleat. Referring to FIGS. 2C and 2E, a length dimension L of the post 220 is greater than its width or transverse dimension W. Specifically, the L/W ratio of the post is greater than 1. By way of further example, L≥2W. Further, the length dimension L of the exposed portion of the cleat 200 or post 220 may be greater than a length dimension BL of the embedded portion of the cleat or flange 202 (i.e., the L/BL ratio for the cleat is greater than 1).

Figure 2G:
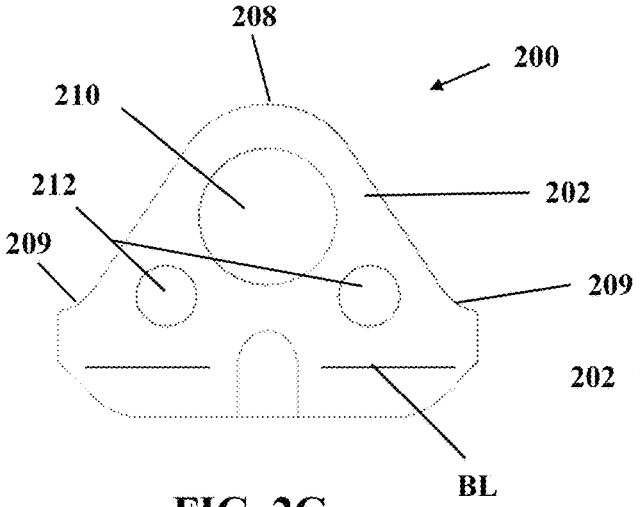
FIG. 2G is a bottom view in plan of the traction element (cleat) of FIG. 2A.
Figure 2H:
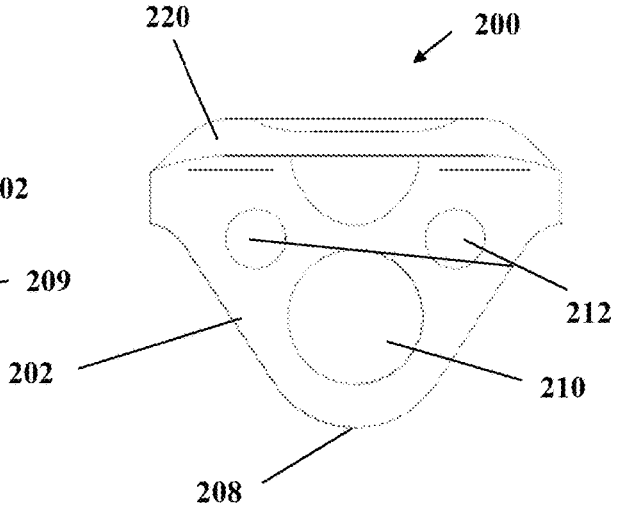
FIG. 2H is a top view in plan of the traction element (cleat) of FIG. 2A.

Referring to FIGS. 2G and 2H, the flange 202 has a generally triangular shape with its base defined at the bend line BL and having a rounded and convex terminal edge 208 defined at the point of the triangle opposing the base. The triangular shape of the flange 202 corresponds in general shape and dimensions with the corresponding nodule 156 of the cleat plate bottom surface 155 to which the cleat is secured. The sides of the flange 202 extend from the convex terminal edge 208 toward the bend line BL and each side curves slightly to form a concave edge 209 at a location close to or proximate the bend line BL.

In an embodiment, the flange length (as measured from the stem/post) is approximately 16 mm (16.18 mm); the flange width is approximately 21 mm (e.g., 21.3 mm); the stem/post length is approximately 18 (17.78); the stem/post width is approximately 8 mm (8.25 mm). The thickness of flange 202 and the post 220 may be generally uniform throughout, being approximately 1.5 mm (1.48-1.58 mm).

The flange 202 also includes a plurality of cut-out sections, openings or windows that extend through the thickness of the flange to reduce the amount of material defined by the flange. This minimizes the weight of the cleat and also the weight imparted to the shoe when a plurality of cleats is connected with the cleat plate. In the example embodiment depicted in FIGS. 2A-2H, the flange 202 includes a first opening 210 and a plurality (e.g., two) of second openings 212 that are smaller in area than the first opening 210 (e.g., a total of three openings, one first opening 210 and two second openings 212). The openings can be circular (as shown in the example embodiment in FIGS. 2A-2H) or have any other suitable shape. The openings are further suitably dimensioned and aligned to facilitate flow of polymer material through the openings and around the flange 202 during formation of the material layers of the cleat plate 150 (e.g., with the cleat suitably oriented in a mold) so as to effectively embed the flange within and affix the cleat to the cleat plate to prevent removal or even motion of the flange within the cleat plate during use of the shoe (e.g., when the ground engaging member of the cleat contacts and/or penetrates a ground surface). The openings can be provided in the flange 202 to encompass at least about 30%, or at least about 40%, or at least about 50%, or even greater than 50% of the surface area along a surface (e.g., outer surface 204 and/or interior surface 206) of the flange.

Referring to FIG. 1C, cleats 200 are oriented along the periphery of the cleat plate 150 and close to a peripheral edge line PEL of the cleat plate bottom surface 155. The peripheral edge line PEL is the edge line at which the bottom surface 155 of the cleat plate 150 ends and the cleat plate transitions to a side surface. Since the cleat plate bottom surface 155 has a shape the generally corresponds with a user's foot, the peripheral edge line PEL curves at locations as it transitions between the medial side 116 and lateral side 118 and around the toe end 112 and the heel end 114 of the shoe 100. Each cleat 200 is located close to the peripheral edge line PEL of the cleat plate bottom surface 155 and also with the outer surface 204 of the ground engaging member 220 facing toward the peripheral edge line PEL. Ten (10) cleats 200 are provided on the bottom surface 155 of the cleat plate 150, with four cleats being provided at the forefoot region 104, two cleats being provided at the midfoot region 106, and four cleats provided at the hindfoot region 108 of the shoe.

The cleats also are oriented such that the outer surface 204 of the ground engaging member 220 for each cleat is substantially parallel with a portion of the peripheral edge line PEL of the cleat plate bottom surface 155 at which the particular cleat is located. This can be seen from the dashed lines for each cleat in FIG. 1C, where the inner dashed line BL is the bend line of the cleat 150 (also generally defining the location of the relatively flat/planar outer surface 204 as it extends from the cleat plate bottom surface 155), and the outer dashed line PEL defines the peripheral edge line (or a tangent line at the peripheral edge location where the cleat is located) of the cleat plate bottom surface 155 at the cleat location. Since the peripheral edge line PEL of the cleat plate bottom surface 155 changes along the periphery of the cleat plate bottom surface (due to the shape/profile of the cleat plate), the cleats 150 change in rotational orientation in relation to each other along the periphery of the cleat plate bottom surface 155 while the interior surfaces 106 of the cleat ground engaging members 220 (as well as the rounded edges 208 of the flanges 202) all face toward each other and toward the central lengthwise axis 160 of the shoe 100.

The cleats 200 are also arranged along the cleat plate bottom surface 155 at each of the forefoot region 104, the midfoot region 106 and/or the hindfoot region 108, as well as along the medial side 116, lateral side 118, toe end 112 and heel end 114 of the shoe 100. In other words, cleats 200 are located at spaced locations around the entire periphery of the cleat plate bottom surface 155. Each cleat 200 (at its specific location of the forefoot, midfoot or hindfoot region of the shoe) can be spaced at about or substantially the same distance from the peripheral edge line PEL of the cleat plate bottom surface 155 as every other cleat on the cleat plate bottom surface. Providing the cleats in this configuration enhances the gripping capabilities of the shoe during use. In addition, certain cleat configurations, such as a ten (10) cleat configuration as shown in FIG. 1C facilitate adequate spacing of the cleats along the cleat plate bottom surface periphery while enhancing gripping performance of the shoe during use. Cleats can be spaced along the cleat plate periphery in any suitable manner from closest neighboring cleats. For example, cleats can be equally spaced from closest neighboring cleats at each (forefoot region, each midfoot region and/or each hindfoot region.

In addition, each cleat 200 is sufficiently dimensioned and is also connected with its base element 202 embedded within the cleat plate 150 such that the exposed or ground engaging members 220 of the cleats 200 all have the same or similar heights or all extend the same or similar distance from the bottom surface 155 of the cleat plate 150. This allows cleats located in close proximity to each other and/or within the same regions of the shoe (forefoot, midfoot or hindfoot regions) to penetrate a ground surface to the same or similar depth during use of the shoe. This further allows the shoe to disperse the force or load applied by a user's foot substantially evenly along the ground surface.

The cleat configuration (including dimensions of the ground engaging members and flanges) and arrangement of cleats on the cleat plate can further be combined with providing a suitable type of midsole to further enhance gripping performance of the shoe. For example, the midsole 130 can be formed of a compressible material (e.g., a specific type of thermoplastic polyurethane or TPU foam and/or other type of foam) having a suitable thickness at the forefoot, midfoot and hindfoot regions (where the thickness of the midsole can vary, decreasing in thickness from the hindfoot region to the forefoot region) that provides a desired level of cushioning or compression when the shoe 100 is pressed down upon a ground surface such that the cleats 200 engage and/or penetrate the ground surface. As previously noted, the material forming the midsole 130 can comprise a foam having a suitable durometer (e.g., measured as Shore A hardness value, such as a Shore A value of about 40-60 and, in particular, Shore A 45-53) that provides sufficient compression at the cleat locations along the cleat plate so as to enable decoupling between the cleat plate and the foot movement to maximize cleat contact time with the ground as well as enhance comfort the user's foot during use of the shoe.

Thus, the combinations of cleat configurations, cleat orientations and locations along the periphery of the cleat plate bottom surface, and midsole material and thickness can all combine to form a shoe having enhanced gripping and traction for the shoe during athletic activities as well as enhancing comfort to the wearer of the shoe during use.

Figure 3A:
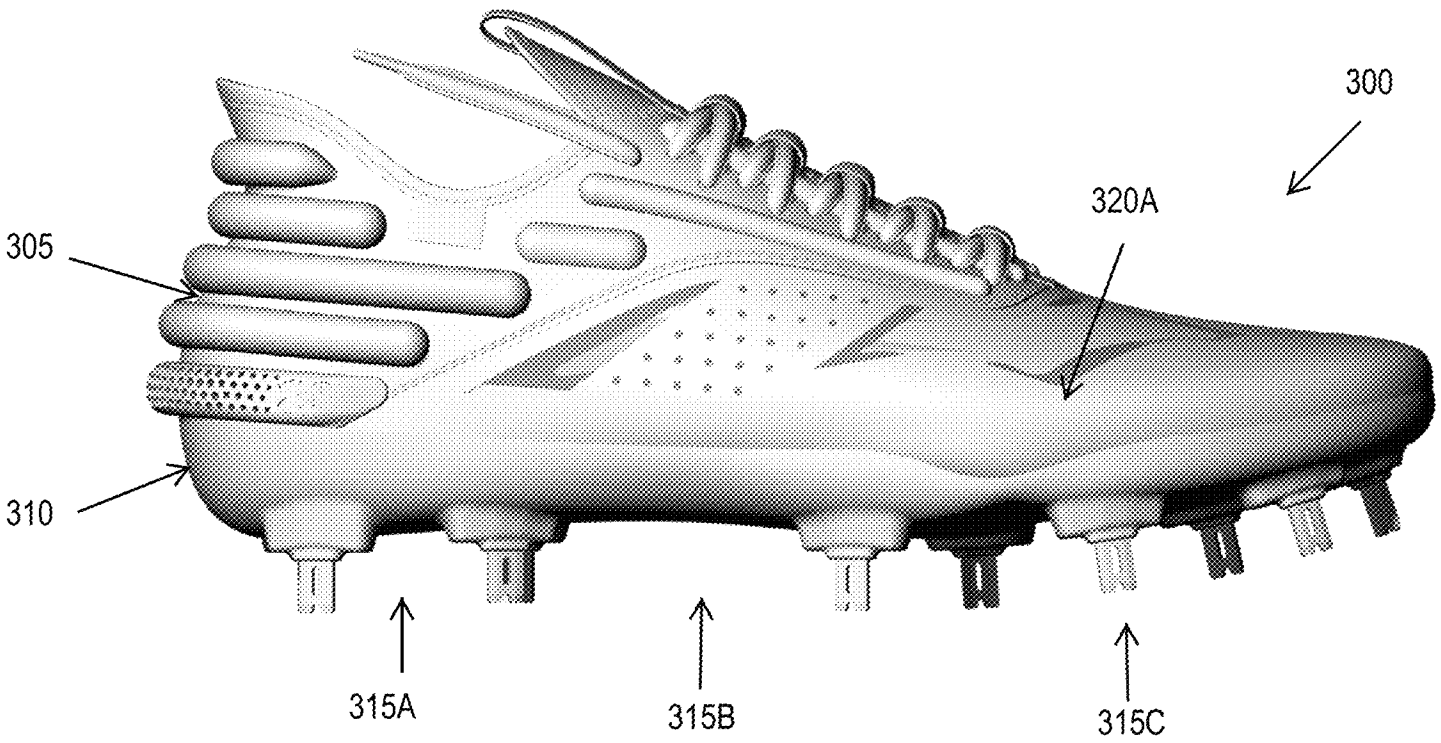
FIG. 3A is a lateral side view of an article of footwear including a cleat plate with traction elements (cleats) according to another embodiment described herein.
Figure 3B:
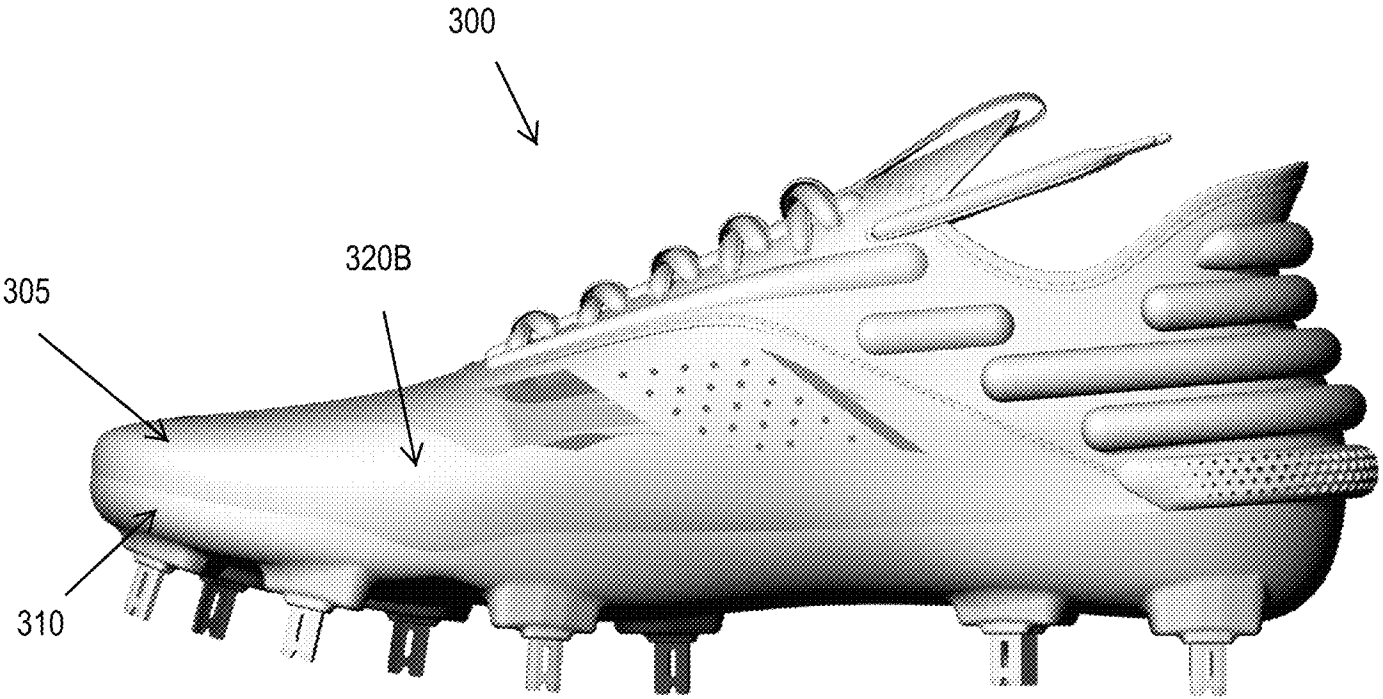
FIG. 3B is a medial side view of the article of footwear of FIG. 3A.
Figure 4A:
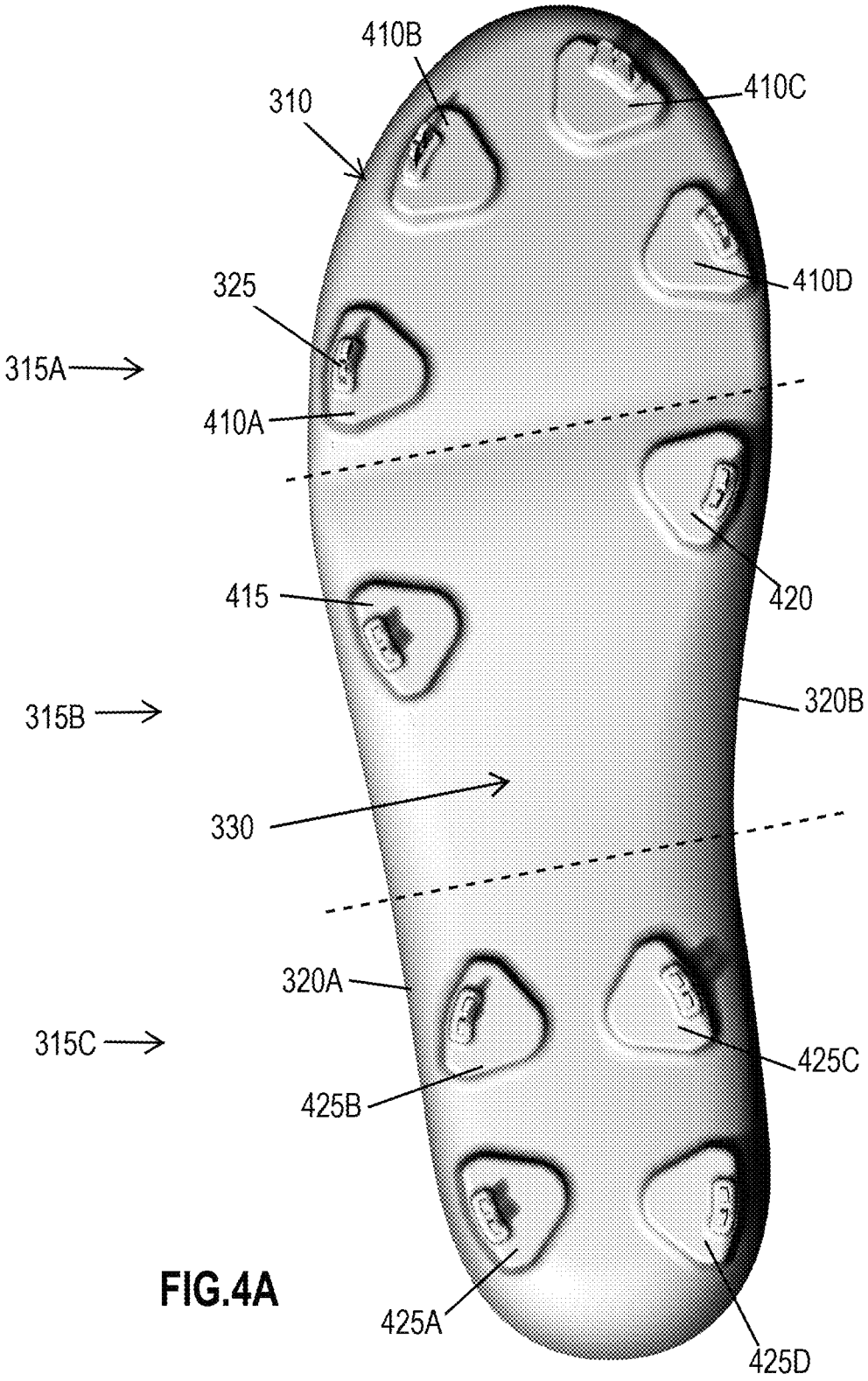
FIG. 4A is a bottom view in plan of the cleat plate for the article of footwear of FIG. 3A.
Figure 4B:
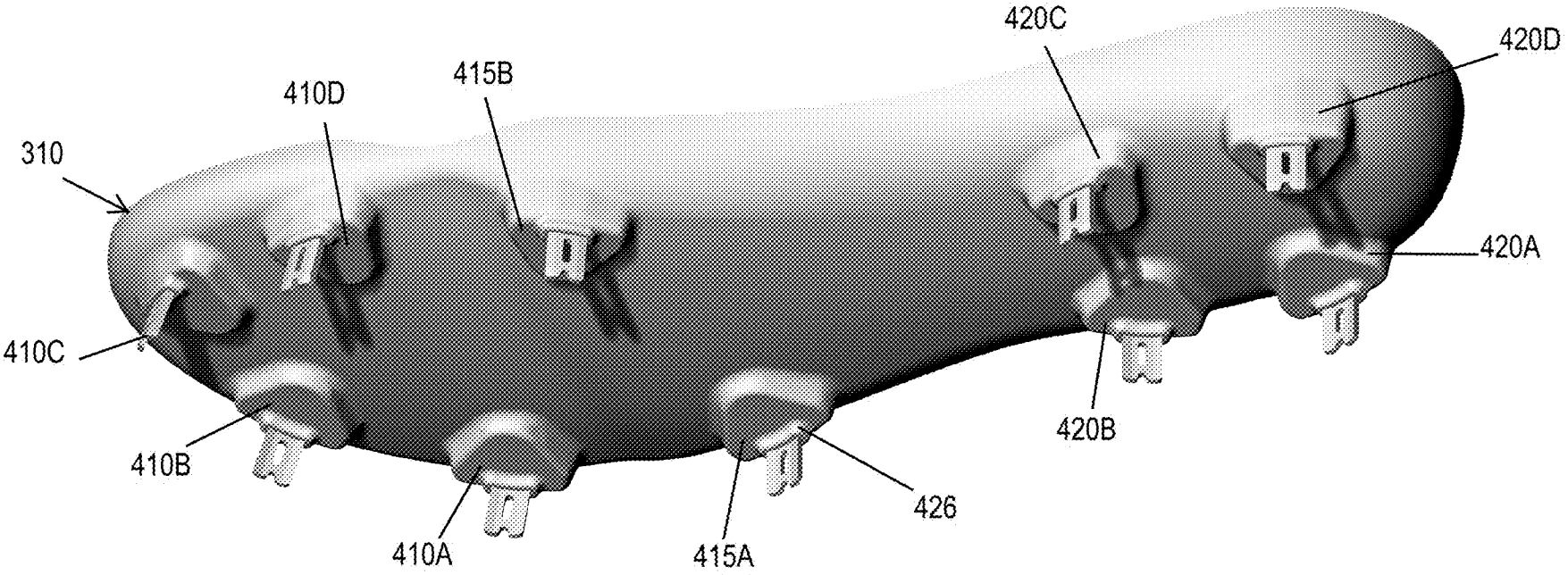
FIG. 4B is a bottom and medial side view in perspective of the cleat plate of FIG. 4A.
Figure 4C:
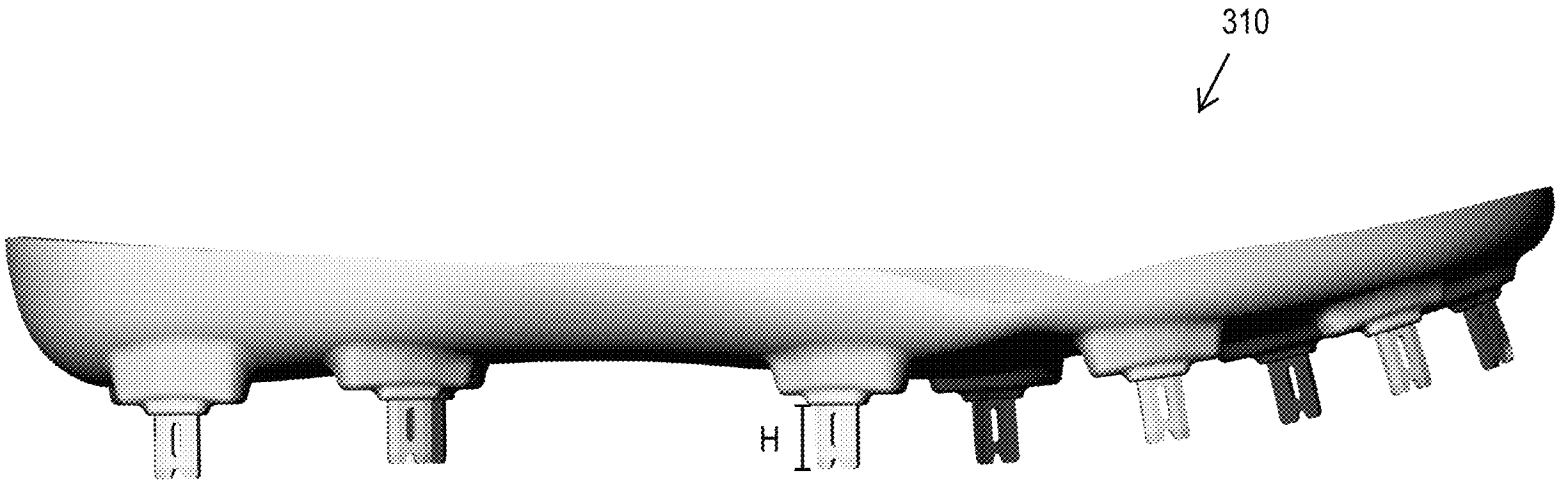
FIG. 4C is a lateral side view in elevation of the cleat plate of FIG. 4A.
Figure 4D:
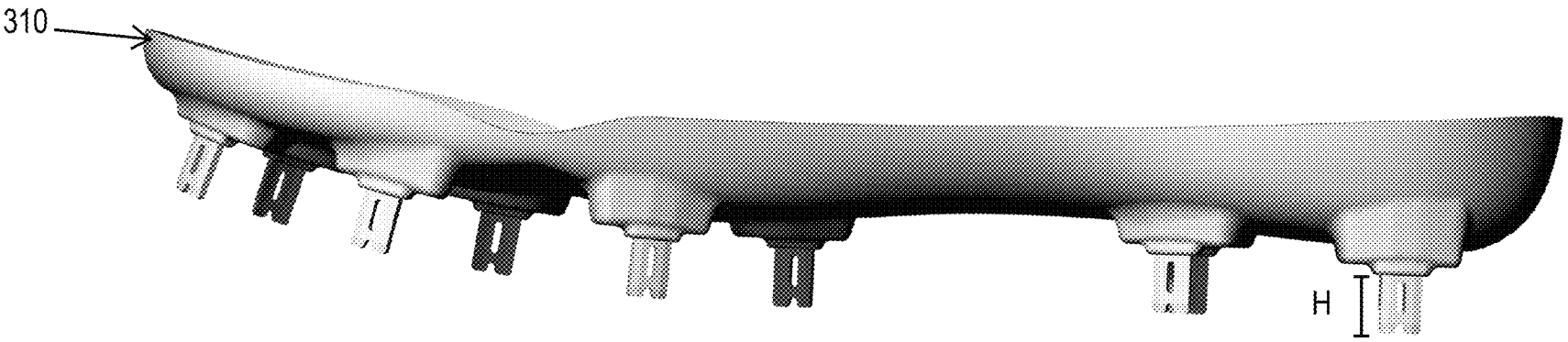
FIG. 4D is a medial side view in elevation of the cleat plate of FIG. 4A.

FIGS. 3-5 illustrate an article of footwear in accordance with another embodiment of the invention. Similar to the shoe described in FIGS. 1A-1C, the article of footwear 300 is a cleated shoe with an upper 305 and an outsole or cleat plate 310. The shoe 300 defines a forefoot region 315A, a midfoot region 315B, and a hindfoot region 315C, along with a lateral side 320A and a medial side 320B. The shoe further includes a midsole similar to that described above, but instead of being an exterior midsole, it is a drop-in midsole placed within the foot cavity of the shoe. The materials forming the drop-in midsole may be the same as described above for the exterior midsole 130. The cleat plate 310 may also be formed of materials similar to that of cleat plate 150. By way of example, the cleat plate 310 is formed of a non-foamed, rigid polymer having sufficient tensile strength and durability (e.g., tensile strength of 1000 MPa or more) such as a thermoplastic polyurethane or a thermoplastic elastomer polyether block amide (e.g., a polyamide 12 compound). Additionally, the cleat plate 310 might be a carbon plate formed of woven carbon fibers embedded in resin. As with the above-described embodiment, the cleat plate 310 further includes a plurality of cleats 325 extending from the bottom or ground-facing surface 330 of the plate.

Referring to FIGS. 4A-4D, the cleats 325 are secured via raised platforms, nodes or nodules integral with the plate, with each nodule at least partially encapsulating the flange or base of the cleat and the ground engaging portion of the cleat protruding outward in a direction substantially perpendicular to the bottom surface of the cleat plate (the cleats are described in greater detail herein). In the embodiment illustrated, the cleat plate 310 includes ten nodules: Four forefoot nodules 410A, 410B, 410C, 410D; a lateral midfoot nodule 415; a medial midfoot nodule 420; and four hindfoot nodules 425A, 425B, 425C, 425D. The nodule may possess any dimensions (size/shape) suitable for its defined purpose (to capture and support a cleat flange). For example, each nodule can have a thickness that is the same or slightly larger than the thickness of each cleat 325 (including the thickness of the flange 510 for the cleat 325). The nodules have the same or substantially similar shapes and dimensions, which (in combination with the cleat dimensions) facilitates the same or uniform height of the cleats extending from the bottom of the cleat plate (as described in further detail herein).

In the illustrated embodiment of FIGS. 4A-4D, each nodule 410, 415, 420, 425 is substantially planar, possessing a generally triangular shape (e.g. equilateral triangle) corresponding to the cleat flange shape. The base of the triangle is oriented outward/outboard, toward the perimeter of the cleat plate. The point of the triangle is pointed inward/inboard, toward the interior of the cleat plate. As described in further detail herein, the cleats 325 includes a base member/base plate or flange that is similar in shape (triangular configuration) and conforms in orientation in relation to its corresponding nodule to which the cleat is attached (thus also orientating the cleat at its nodule location in relation to a peripheral location along the bottom surface of the cleat plate 310). Each nodule further includes a slightly raised stepped portion 426 extending from its planar, ground facing surface, where stepped portion 426 extends around the stem or post of the corresponding cleat 325 that is secured to the nodule.

Referring to FIGS. 5A-5D, the traction elements or cleats 325 are similar to the cleat 200 depicted in FIGS. 2A-2H, where each includes a plate 500 bent at a bend line 505 to form a base member or flange 510 and a ground-engaging member, stem or post 515 extending at an angle from the flange. By way of example, the post 515 is generally orthogonal to the flange 510, being oriented at a 90° angle thereto. The flange 510 and post 515 may each possess any dimensions suitable for its described purpose. For example, the flange and post dimensions for cleat 325 can be the same or similar to those described herein for cleat 200 and include the same or similar L/W ratios in dimensions for the length vs. width of the post as well as L/BL ratios in dimensions for the length of the post vs. length of the flange for the cleat.

As shown in the figures, the flange possesses a generally triangular shape defining a distal point 520 bounded by a pair of lateral notches 525A, 525B extending inboard. As with cleat 200, the flange includes a large central aperture or window 530A, as well as smaller, lateral windows 530B, 530C. Similar to the cleat 200, the apertures or windows 530 provided in the flange 510 reduce the amount of material for the flange 510 so as to reduce the weight of the cleat 325 as well as provide openings to facilitate flow of polymer material through the openings and around the flange 510 during formation of the cleat plate (e.g., with the cleat suitably oriented in a mold). This allows the base member or flange of the cleat to be effectively embedded within the cleat plate (e.g., within the cleat plate nodule) so as to firmly affix the cleat to the outsole/cleat plate to prevent removal or even motion of the flange within the cleat plate during use of the shoe (e.g., when the ground engaging member or stem/post of the cleat contacts and/or penetrates a ground surface). The openings or windows 530 can be provided in the flange 510 to encompass at least about 30%, or at least about 40%, or at least about 50%, or even greater than 50% of the surface area along a surface of the flange.

The post 515 includes an elongated or elliptical shaped central opening or window 540 and a semi-circular notch 545 disposed at its free or terminal end. In addition, similar to the cleat 200, the post 515 of the cleat 325 has a generally rectangular configuration with its distal fee end or terminal end that may be tapered so as to enhance engagement and penetration into a ground surface when the shoe engages the ground surface during use. An indentation or dimple 548 is provided along the outer surface and at the bend line 505 of the cleat 325, and a corresponding bump 546 is provided along the inner surface of the cleat 325 at the bend line 505. Similar to cleat 200, the bump 546 and dimple 548 for cleat 325 can be suitably aligned and dimensioned to enhance the strength and structural integrity for the configuration of the cleat 325 so as to prevent undesirable bending of the post 515 at the bend line 505 and beyond its orthogonal (or other set angled) position in relation to the flange 510 during use of the shoe (e.g., during activities in which the cleat is forced down so as to contact and/or penetrate a ground surface).

Figure 5A:
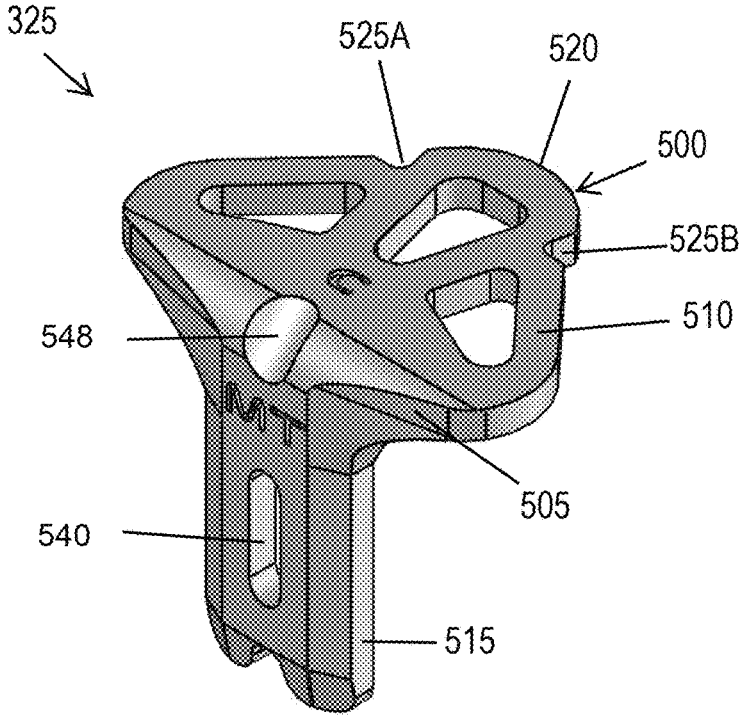
FIG. 5A is a bottom and rear view in perspective of a traction element (cleat) for the article of footwear of FIG. 3A.
Figure 5B:
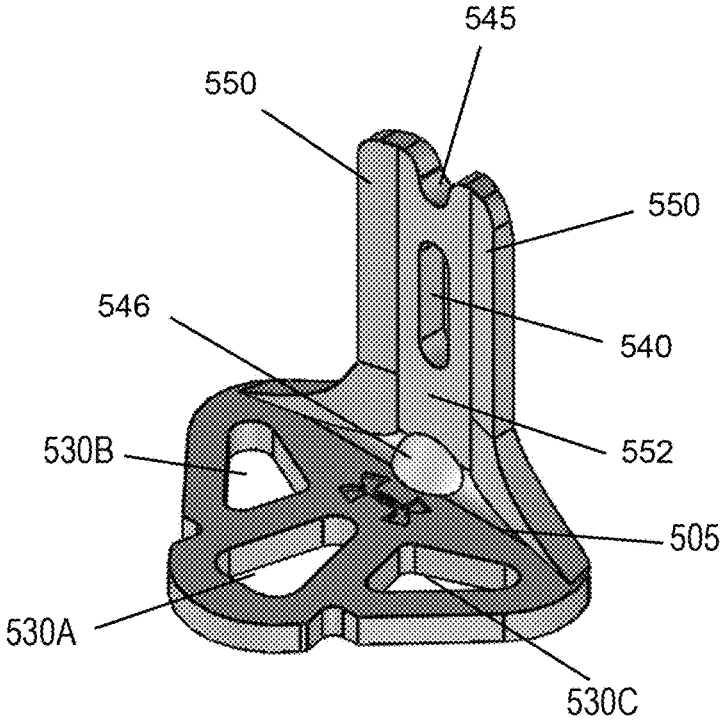
FIG. 5B is a front and top view in perspective of the traction element (cleat) of FIG. 5A.
Figure 5C:
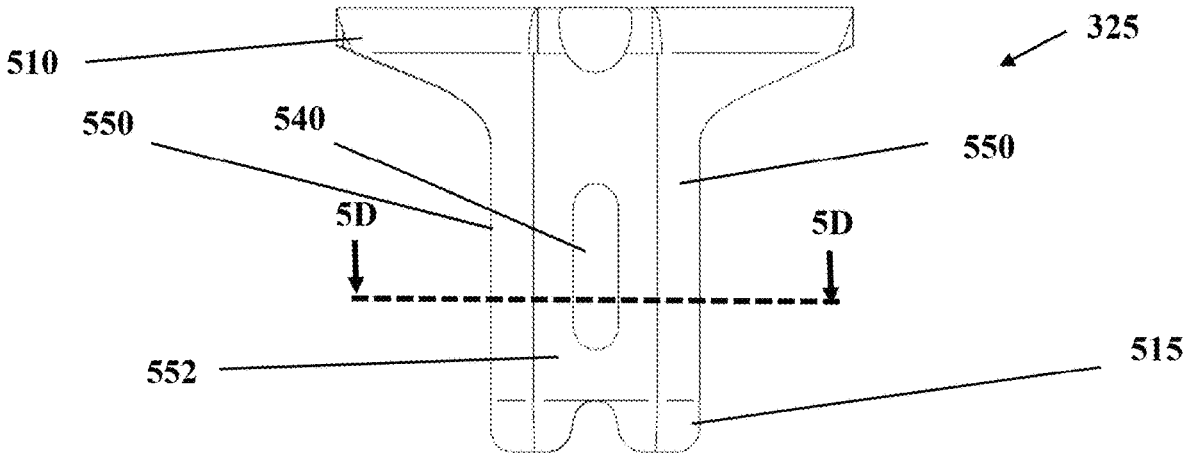
FIG. 5C is a rear view in elevation of the traction element (cleat) of FIG. 5A.
Figure 5D:
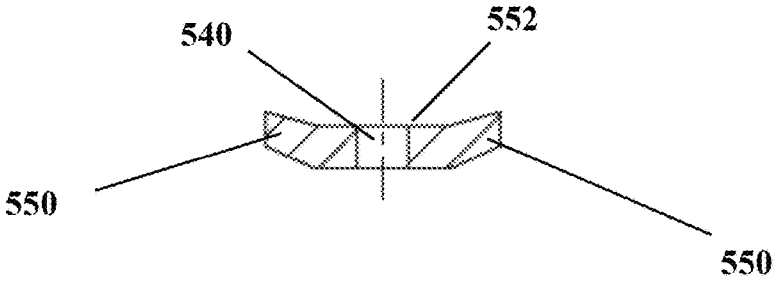
FIG. 5D is a cross-sectional view of the traction element (cleat) of FIG. 5C taken along dashed line 5D-5D, which shows the beveled or chamfered side edge portions that bend inwardly (toward the front of the cleat) in relation to a central portion of the cleat post.

The post 515 further includes a central portion 552 (which includes the window 540). The post further includes a generally planar edge member 550 defined along each lengthwise side of the central portion 552. The edge members 550 extend inward (i.e., away from the rear side of the cleat and in a same direction as the flange 510 extends away from the post 515) at a slight angle from the central portion 552 (see, e.g., the cross-sectional view of the cleat 325 as depicted in FIG. 5D). To put it another way, the post 515 includes a first planar surface (a first edge member 550) angled with respect to a second planar surface (central portion 552) along a first vertical junction (i.e., the transition between first edge member and central portion), and further a third planar surface (a second edge member 550) angled with respect to the second planar surface (central portion 552 along a second vertical junction (i.e., the transition between second edge member and central portion). Each edge member 550 extends at an obtuse angle (e.g., an angle in the range from about 120° to about 170°, such as an angle about 150-165°) from the central portion 552 so as to form a beveled or chamfered surface along the outer surface of the post 515. This results in a multi-faceted post having a three-dimensional outer (and inner) surface. The angled/beveled configuration of the side edges or edge members 550 enhances the effectiveness of the post 515 in penetration into and gripping of the cleat plate 310 with the ground surface during use of the shoe. In addition, this angled/beveled configuration of the edge members 550 for the cleats 325 (along with the arrangement/orientations of the cleats along the cleat plate) can enhance the gripping action of the shoe with the ground surface to prevent or limit sliding and/or rotational movements of the cleat plate when engaged with the ground during use of the shoe.

Each cleat 325 is also installed with the flange 510 embedded within a corresponding nodule (e.g., nodule 410, 415, 420 or 425) of the cleat plate 310, where the cleats and the nodules are also suitably dimensioned such that all of the terminal ends of all of the cleat posts 515 extend at substantially the same distance from the nodules and also substantially the same distance from the bottom or ground facing surface of the cleat plate 310. The stepped portion 426 of each nodule surrounds its corresponding cleat post 515 to provide further enhanced securing of the cleat 325 with the nodule thus preventing or substantially limiting its movement independently from the cleat plate during use of the shoe. Referring, e.g., to FIGS. 4C and 4D, the exposed portion of the post 515 for each cleat 325 extends the same or substantially similar length or distance H from the planar and ground facing surface of its corresponding nodule to which the cleat flange 510 is secured. Since each nodule has the same or substantially similar dimensions, this also results in the terminal or free ends of the cleat posts extending the same or similar distance from the ground facing surface of the cleat plate 310. This allows cleats located in close proximity to each other and/or within the same regions of the shoe (forefoot, midfoot or hindfoot regions) to penetrate a ground surface to the same or similar depth during use of the shoe. This further allows the shoe to disperse the force or load applied by a user's foot substantially evenly along the ground surface.

Referring again to FIG. 4A, the orientations and arrangements of cleats 325 along the cleat plate 310 corresponds with the locations (and orientations) of nodules along the cleat plate. In particular, four cleats 325 are embedded/secured with the corresponding four forefoot nodules 410A, 410B, 410C, 410D at the forefoot region 315A of the shoe; two cleats 325 are embedded/secured with the corresponding lateral midfoot nodule 415 and medial midfoot nodule 420 at the midfoot region 315B of the shoe; and four cleats 325 are embedded/secured with the corresponding hindfoot nodules 425A, 425B, 425C, 425D at the hindfoot region 315C of the shoe. Thus, the embodiment of FIGS. 3-5 (like the embodiment of FIGS. 1-2) has a ten (10) cleat configuration.

The cleats 325 are also oriented with the distal point 520 of each cleat extending toward an interior or central region (or longitudinal/lengthwise center line) of the cleat plate 310 and shoe. In addition, each cleat 325 and its corresponding nodule is located at an outer peripheral edge line of the cleat plate 310 (i.e., the edge line at which the bottom/ground facing surface of the cleat plate 310 ends at an outermost edge and the cleat plate transitions to a side surface), with the outer surface (rear side) of the post 515 of each cleat 325 facing toward the cleat plate peripheral edge line. Thus, the cleats are all located along the outer periphery of the bottom or ground facing surface of the cleat plate 310, with some cleats being slightly rotated along their lengthwise axes in relation to other cleats and with no other cleat being disposed any closer toward the interior or the central region of the cleat plate. Further, and similar to the cleat arrangement/orientation for the shoe of FIG. 1, at least some of the cleats 325 are arranged and orientated along the cleat plate 310 such that the outer surface (rear side) of the cleat is substantially parallel with a portion of the peripheral edge line of the cleat plate bottom surface at which the particular cleat is located. Since the outer peripheral edge line of the cleat plate bottom surface changes along the periphery of the cleat plate bottom surface (due to the shape/profile of the cleat plate), the cleats 325 change in rotational orientation in relation to each other along the periphery of the cleat plate bottom surface while the interior surfaces (front sides) of the posts 515 (as well as the points 520 of the flanges 510) all face toward each other and toward interior surface portions and/or the central lengthwise axis of the cleat plate and shoe. Some or all of the cleats 325 (at the specific cleat location of the forefoot, midfoot or hindfoot region of the shoe) can also be spaced at a similar or substantially the same distance from the outer peripheral edge line of the cleat plate 310 as some or all of the other cleats on the cleat plate bottom surface.

Providing the cleats in this configuration, along with the size and shape of the cleats and their connection with nodules at the bottom of the cleat plate enhances the gripping capabilities of the shoe during use. Any suitable orientation and number of cleats can be provided at the forefoot, midfoot and hindfoot regions and in close proximity to the outer peripheral edge line of the cleat plate to enhance performance of the shoe for a specific application or purpose.

Figure 6:
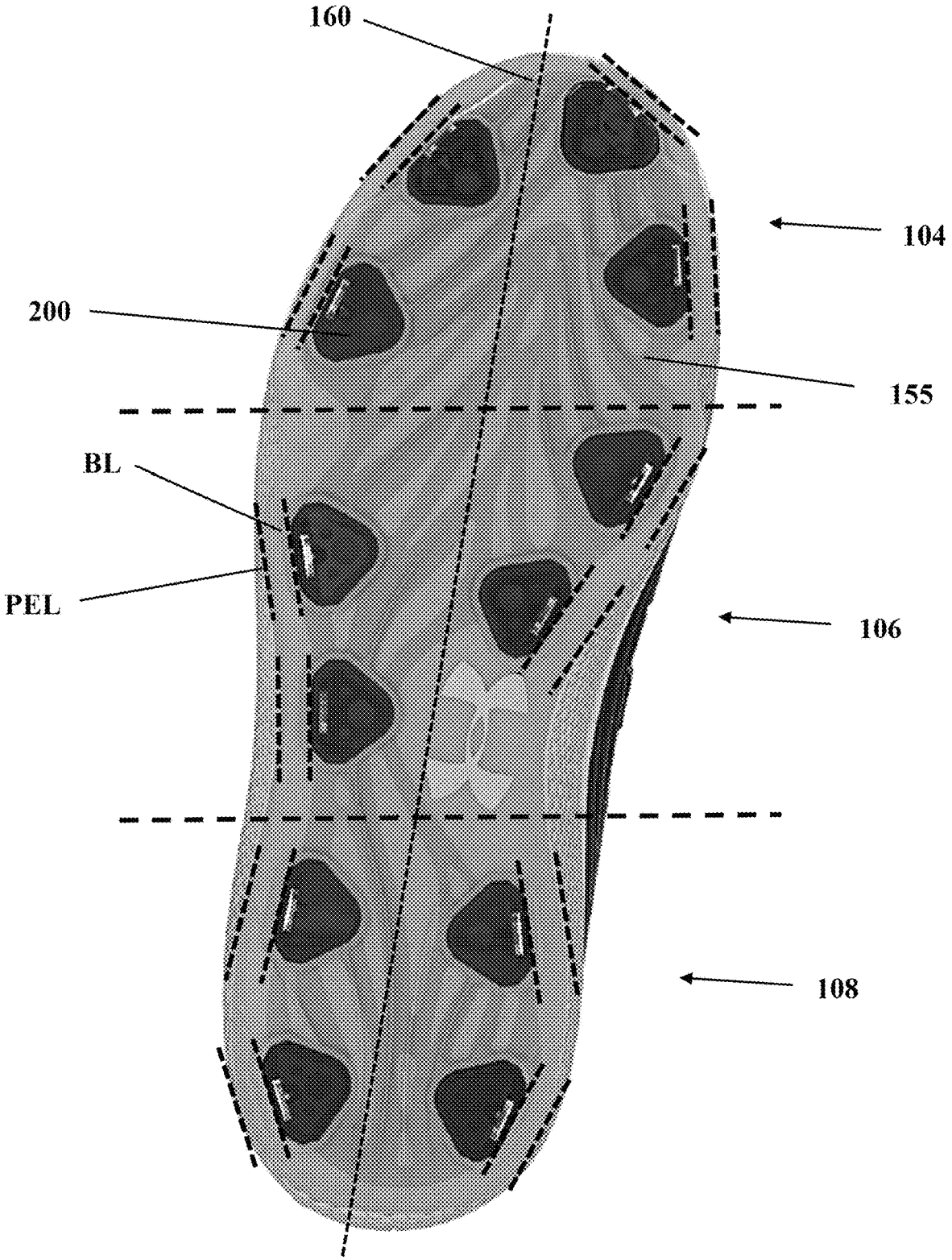
FIG. 6 is a bottom view in plan of a further embodiment of an article of footwear incorporating traction elements (cleats) having the configuration of the cleat depicted in FIG. 2A.

For example, while each embodiment depicted in FIGS. 1-2 and FIGS. 3-5 includes a ten (10) cleat configuration (with four cleats located at the forefoot region of the shoe, 2 cleats located at the midfoot region of the shoe, and four cleats located at the hindfoot region of the shoe), the embodiment of FIG. 6 depicts a shoe similar to that shown in FIGS. 1-2 but including twelve (12) cleats instead of ten (10) cleats. In particular, the cleat plate and cleats depicted in FIG. 6 are substantially similar to the same components depicted in FIGS. 1 and 2. However, in the embodiment of FIG. 6, four cleats are provided in the midfoot region 106, with two cleats 200 located at the outer peripheral edge along the medial side of the shoe and two cleats located at the outer peripheral edge along the lateral side of the shoe. This configuration can be provided to further enhance gripping of the shoe with the ground surface at the midfoot region of the shoe for a particular application.

Still other cleat configurations can be used while providing the same or similar features for the shoe. As previously noted, cleats can be co-molded so as to be integral with the cleat plate of the shoe. In addition, cleats can also be configured to removably connect (e.g., via a threaded or other connection) with the cleat plate of the shoe.

Figure 7A:
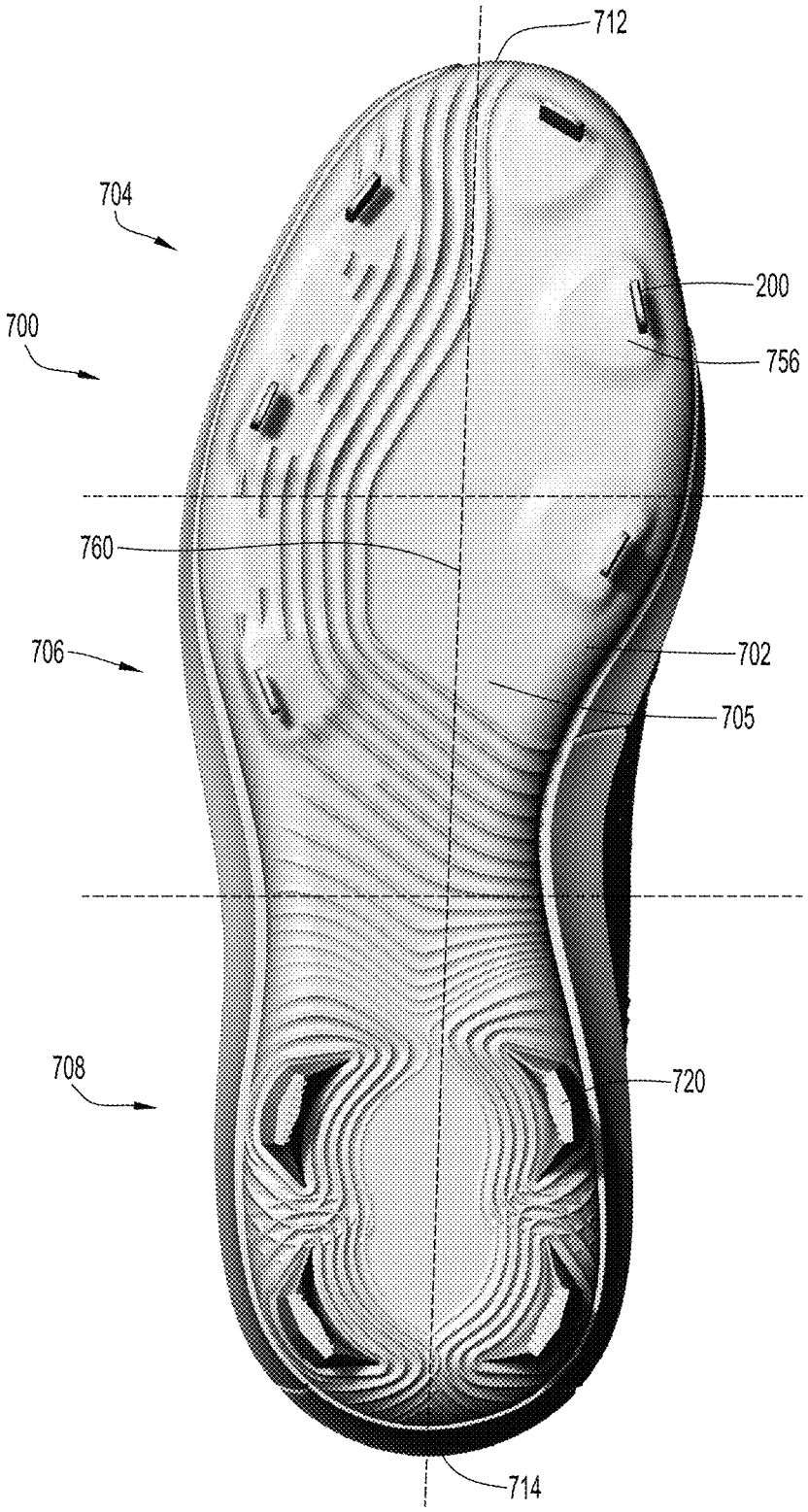
FIG. 7A is a bottom view in plan of another embodiment of an article of footwear incorporating traction elements having the configuration of the cleat depicted in FIG. 2A and located along a portion of the cleat plate that includes the forefoot region of the article of footwear, and further including polymer (TPU) cleats located along a portion of the cleat plate that includes the hindfoot region of the article of footwear.
Figure 7B:
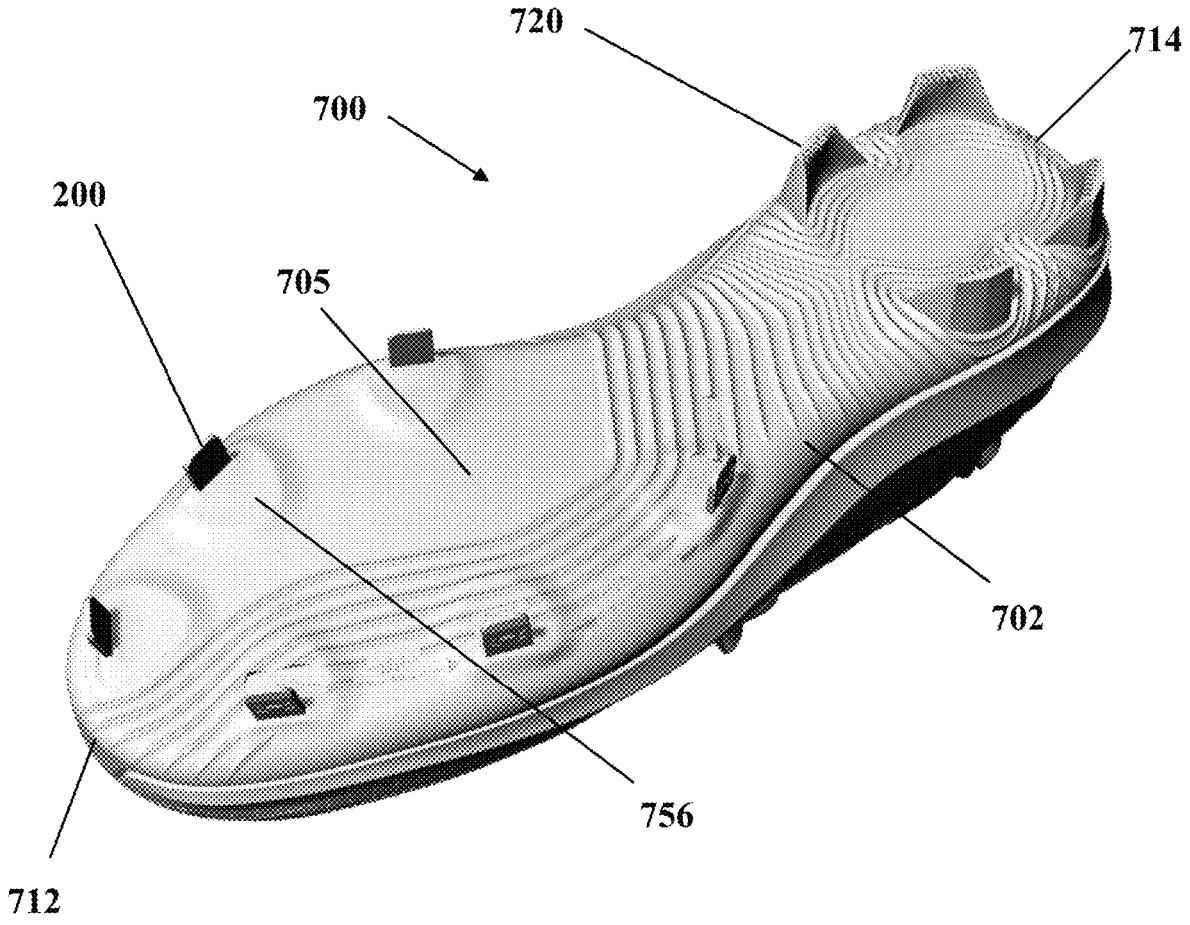
FIG. 7B is a bottom view in perspective of the article of footwear of FIG. 7A.

In a further embodiment depicted in FIGS. 7A and 7B, an article of footwear or shoe 700 includes a cleat plate 702 including a bottom surface 705 with a combination of different cleats. The different cleats comprise a first set of cleats 200 (previously described herein) and a second set of cleats 720. The cleats 200 of the first set are connected at nodules 756 arranged along and near the periphery of the bottom surface 705, where the nodules 756 are oriented in a manner similar to the arrangement of how cleats 200 with how the nodules 156 are arranged along the bottom surface 155 of the cleat plate 150 in the embodiment of FIGS. 1A-1D. The cleats 200 are formed of a metal (e.g., stainless steel, titanium, aluminum, one or more other grades of steel as well as other types of metals). The cleats 720 of the second set are connected directly to the bottom surface 705 of the cleat plate 702 and are formed of a polymer material, such as a thermoplastic polyurethane (TPU) material. The polymer cleats 720 can be co-molded and integral with the bottom surface 705 of the cleat plate 702. Alternatively, each of the polymer cleats 720 can include a base portion that, similar to cleats 200, is formed within a portion of the cleat plate. The cleats 720 formed of the polymer material have a durometer value (e.g., Shore A hardness value) that is less than the durometer value of the metal cleats 200. Accordingly, cleats 720 are less rigid and capable of greater flexion in relation to the cleats 200 when the shoe 700 engages a ground surface.

The metal cleats 200 are arranged along the cleat plate bottom surface 705 such that at least some of the metal cleats 200 are located at the forefoot region 704 of the shoe 700, including metal cleats 200 disposed at or near the toe end 712 of the shoe 700. As shown in FIG. 7A, some of the metal cleats 200 are also located along the bottom surface 705 at the midfoot region 706 of the shoe 700. At least some of the polymer cleats 720 are located along the bottom surface 705 at the hindfoot region 708 of the shoe 700, including polymer cleats 720 disposed at or near the heel end 714. In the example embodiment depicted in FIG. 7A, all of the polymer cleats 720 are disposed at the hindfoot region 708. In particular, in the embodiment, four metal cleats 200 are disposed at the forefoot region 704, two metal cleats 200 are disposed at the midfoot region 706, and four polymer cleats 720 are disposed at the hindfoot region 708. All of the cleats 200, 720 are disposed at or near the periphery of the bottom surface 705 in an orientation similar to that described for the cleats of the shoe 100 depicted in FIGS. 1A-1D, where each cleat 200, 720 is located close to a peripheral edge line of the cleat plate bottom surface 705 and with an outer surface of the ground engaging member (i.e., portion of the cleat that extends from the cleat plate bottom surface) of each cleat facing toward the peripheral edge line and away from a central lengthwise axis 760 of the shoe 700.

Both sets of cleats 200, 720 are further sufficiently dimensioned such that the exposed ground engaging members of all of the cleats (i.e., all types of cleats) have the same or similar heights or all extend the same or similar distance from the bottom surface 705 of the cleat plate 702. However, each polymer cleat 720 has a width and/or thickness dimension that is greater than each metal cleat 200. Providing the cleats with the same or similar lengths extending from the bottom surface of the cleat plate allows for cleats located in close proximity to each other and/or within the same regions of the shoe (forefoot, midfoot or hindfoot regions) to penetrate a ground surface to the same or similar depth during use of the shoe. This further allows the shoe to disperse the force or load applied by a user's foot substantially evenly along the ground surface at certain locations.

Further, the difference in hardness and flexion associated with the different sets of cleats, with the polymer cleats 720 being located in the hindfoot region 708 and disposed at or around the heel end 714 of the shoe 700, allows for a greater degree of flexion or compression at the heel end in comparison to the toe end of the shoe when the shoe is worn and being used in athletic or other activities. This also allows for a greater degree of comfort for the wearer of the shoe at the heel end without sacrificing combined gripping action of the cleat system during use. For example, in scenarios in which an athlete might be standing still for a certain portion of time during a sporting activity (e.g., an outfielder in baseball), the polymer cleats 720 provided at the hindfoot region 708 and heel end 714 of the shoe 700 provides less rigidity and enhanced comfort for the wearer at or near the heel.

Any other suitable combinations of two or more types of cleats (e.g., polymer cleats and/or metal cleats) having different durometer values can also be implemented in cleat arrangements and orientations along a bottom surface of a cleat plate and which can provide enhanced features for a shoe depending upon a particular purpose or application.

It is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", "outer" and the like as can be used herein, merely describe points of reference and do not limit the present invention to any particular orientation or configuration.

What is claimed:

1. A traction element for an article of footwear, the traction element comprising:

a base member that is dimensioned to be embedded within a cleat plate of the article of footwear, the base member including a plurality of openings extending through the base member to facilitate portions of the cleat plate extending through the openings during installation of the base member in the cleat plate, wherein the plurality of openings includes a first opening and a pair of second openings smaller in size in relation to the first opening; and a ground engaging member that extends at an angle from the base member so as to be exposed and extend transversely from the bottom surface of the cleat plate when the base member is installed within the cleat plate, wherein the ground engaging member has a length that is greater than a lengthwise dimension of the base member, and the ground engaging member comprises:

a first plate having a first planar surface;

a second plate having a second planar surface angled from the first planar surface of the first plate and joining with the first plate along a first side of the first plate so as to define a first vertical junction entirely along the first side between the first plate and the second plate; and a third plate having a third planar surface angled from the first planar surface of the first plate and joining with the first plate along a second side that opposes the first side of the first plate so as to define a second vertical junction entirely along the second side between the first plate and the third plate;

wherein the first plate includes an elongated opening extending through the first plate and a notch defined at a free end of the first plate.

2. An article of footwear comprising:

an upper;

a cleat plate coupled to the upper, the cleat plate including a plurality of nodules formed integral with the cleat plate, each nodule extending outward from a bottom surface of the cleat plate; and a plurality of metal cleats, each metal cleat associated with a corresponding nodule such that the metal cleat is encapsulated partially within the nodule and protrudes therefrom in a direction substantially perpendicular to the bottom surface of the cleat plate;

wherein:

each metal cleat within the plurality of metal cleats extends a same distance from the bottom surface of the cleat plate;

each metal cleat comprises a first planar portion and a second planar portion angled with respect to the first planar portion along a bend line such that the second planar portion is oriented generally orthogonally to the first planar portion, the second planar portion is embedded within the corresponding nodule while at least part of the first planar portion extends from the corresponding nodule and the bottom surface of the cleat plate;

each second planar portion includes a plurality of openings extending through the second planar portion; and the first planar portion of each metal cleat comprises:

a first plate having a first planar surface, an elongated opening extending through the first plate and a notch defined at a free end of the first plate;

a second plate having a second planar surface angled from the first planar surface of the first plate and joining with the first plate along a first side of the first plate so as to define a first vertical junction entirely along the first side between the first plate and the second plate; and a third plate having a third planar surface angled from the first planar surface of the first plate and joining with the first plate along a second side that opposes the first side of the first plate so as to define a second vertical junction entirely along the second side between the first plate and the third plate.

3. The article of footwear according to claim 2, wherein the first planar portion extends distally from the bend line to define a distal edge.

4. The article of footwear according to claim 2, wherein the second planar portion is a generally triangular plate.

5. The article of footwear of claim 2, further comprising:

a plurality of polymer cleats connected with the bottom surface of the cleat plate, wherein each polymer cleat within the plurality of polymer cleats extends a same distance from the bottom surface of the cleat plate.

6. The article of footwear of claim 5, wherein each polymer cleat within the plurality of polymer cleats is located along the bottom surface of the cleat plate at a hindfoot region of the article of footwear.

7. The article of footwear of claim 2, wherein:

the first metal portion of each metal cleat includes an interior surface that faces toward a central location of the cleat plate and an outer planar surface that faces away from the central lengthwise axis of the article of footwear; and the outer planar surface of the first metal portion for each metal cleat faces toward and is in alignment and parallel with a corresponding peripheral edge line portion for the bottom surface of the cleat plate.

* * * * *